US007287844B2

(12) United States Patent
Wakayama et al.

(10) Patent No.: US 7,287,844 B2
(45) Date of Patent: Oct. 30, 2007

(54) INK CONTAINER AND INK CONTAINER LOADING STRUCTURE

(75) Inventors: Takahiro Wakayama, Ami-machi (JP); Takashi Miyazawa, Hachioji (JP); Masashi Matsuda, Hachioji (JP)

(73) Assignee: Riso Kagaku Corporation, Shiba Minato-Ku, Tokyo (JP)

( * ) Notice: Subject to any disclaimer, the term of this patent is extended or adjusted under 35 U.S.C. 154(b) by 0 days.

(21) Appl. No.: 10/574,559

(22) PCT Filed: Oct. 7, 2004

(86) PCT No.: PCT/JP2004/015193

§ 371 (c)(1),
(2), (4) Date: Apr. 3, 2006

(87) PCT Pub. No.: WO2005/035256

PCT Pub. Date: Apr. 21, 2005

(65) Prior Publication Data

US 2007/0035591 A1 Feb. 15, 2007

(30) Foreign Application Priority Data

Oct. 10, 2003 (JP) ..... 2003-351825

(51) Int. Cl.
*B41J 2/175* (2006.01)

(52) U.S. Cl. ..... 347/86

(58) Field of Classification Search ..... 347/49, 347/85, 86

See application file for complete search history.

(56) References Cited

U.S. PATENT DOCUMENTS

| | | | | |
|---|---|---|---|---|
| 5,815,183 | A | 9/1998 | Sasaki | |
| 6,164,769 | A | 12/2000 | Inada et al. | |
| 6,390,601 | B1 * | 5/2002 | Morita et al. | 347/49 |
| 6,959,985 | B2 * | 11/2005 | Steinmetz et al. | 347/86 |
| 2004/0257410 | A1 | 12/2004 | Yamada et al. | |

FOREIGN PATENT DOCUMENTS

| | | |
|---|---|---|
| JP | 10029298 | 2/1998 |
| JP | 2003311994 | 11/2003 |

* cited by examiner

*Primary Examiner*—Anh T. N. Vo
(74) *Attorney, Agent, or Firm*—Frommer Lawrence & Haug LLP; Matthew K. Ryan, Esq.

(57) ABSTRACT

An ink container filling structure comprising an ink container removably mountable in a recording device, and an ink container filling section having a fit section in which the ink container is filled and which fits in the delivery port of the ink container, wherein when the ink container is removed from the ink container filling section, the ink is prevented from dripping from the ink delivery port to soil the operator's hand or the ink container filling section peripherals. It is arranged that the direction (the direction of arrow (A)) of fitting the fit section (20) in the delivery port (11) of the ink container (1) is obliquely downward with respect to the horizontal direction.

8 Claims, 4 Drawing Sheets

INK CONTAINER AND INK CONTAINER LOADING STRUCTURE

This U.S. application Ser. No. 10/574,559 was filed on Apr. 3, 2006 as a National Phase entry under 35 U.S.C. §371 of PCT International Application No. PCT/JP2004/015193, filed Oct. 7, 2004 which was published in Japanese as WO 2005/035256 on Apr. 21, 2005, and which claims priority of Japanese application 2003-351825, filed Oct. 10, 2003. Each document cited or referenced in this application are incorporated herein by reference.

FIELD OF THE INVENTION

This invention relates to an ink container having an ink discharge port, and an ink container loading structure formed by an ink container and an ink container loading portion in which the ink container is loaded.

BACKGROUND OF THE INVENTION

There have been in wide use a changeable ink container, in recording apparatuses for instance, a stencil printer or an ink jet printer and various ink containers have been proposed.

As an above-mentioned ink container, there has been proposed an ink container, as disclosed in Japanese Unexamined Patent Publication No. 10(1999)-29298, which has an ink discharge port provided in one end face thereof and is loaded in and removed from the recording apparatus horizontally by way of the ink discharge port.

However such an ink container is disadvantageous in that since the ink container is loaded in the ink container loading portion of the recording apparatus with its ink discharge port held horizontally, ink can remain on the inner side of the ink discharge port and/or near the ink discharge port even after the ink in the ink container is used up and the remaining ink can run from the ink container to stain the operator's hand or the recording apparatus's surroundings of the ink container loading portion when the ink container is removed from the recording apparatus. Especially, when the ink container is filled with a low viscosity ink, the remaining ink is more apt to run.

In view of the foregoing observations and description, the primary object of the present invention is to provide an ink container removable from a recording apparatus and an ink container loading structure in which ink can be prevented from running from the ink container to stain the operator's hand or the recording apparatus's surroundings of the ink container loading portion when the ink container is removed from the recording apparatus.

SUMMARY OF THE INVENTION

In accordance with the present invention, there is provided an ink container loading structure comprising an ink container provided with a container body in which ink is stored and an ink discharge port through which ink in the container body is discharged and an ink container loading portion provided with an ink container engagement portion in which the ink container is loaded and with which the ink discharge port of the ink container is engaged, wherein the improvement comprises that the ink container engaging direction of the ink discharge port of the ink container with the ink container engagement portion is directed obliquely downward with respect to the horizontal.

In accordance with the present invention, there is further provided an ink container which is employed in the ink container loading structure described above and in which the ink discharge port is provided in an end face of the ink container in the ink container loading direction.

The "ink container loading direction" means the direction in which the ink container is moved when it is loaded in the ink container loading portion. For example, though it is preferred that the ink container loading direction be the same as the above ink container engaging direction, the ink container loading direction need not be so.

In accordance with the present invention, there is further provided an ink container provided with a container body in which ink is stored and an ink discharge port through which ink in the container body is discharged, wherein the improvement comprises that the ink discharge port of the ink container is formed in an end face of the container body so that the central axis of the ink discharge port is directed obliquely downward with respect to the direction in which the upper side surface of the container body extends.

The container may be formed so that the direction of normal of the end face in which the ink discharge port is formed is parallel to the direction of the central axis of the ink discharge port.

Further, it is possible to provide a vent hole for taking the atmosphere in the container body in the upper part of the end face in which the ink discharge port is formed so that the direction of the central axis of the vent hole is directed obliquely downward with respect to the direction in which the upper side surface of the container body extends.

The direction of central axis of the ink discharge port may be parallel to the direction of the central axis of the vent hole.

The "direction of the central axis of the ink discharge port" means a direction in which ink is discharged out of the directions in which the central axes of the ink discharge port extend.

The "direction of the central axis of the vent hole" means a direction opposite to the direction in which the atmosphere is taken in the container body out of the directions in which the central axes of the vent hole extend.

Further, the "upper side surface" means a side surface of the ink container opposed to the side of the ink discharge port in the end face in which the ink discharge port is formed out of the side surfaces of the ink container. That is, the side on which the ink discharge port is provided in the above end face is referred to as the lower side and the side opposite to the side on which the ink discharge port is provided in the above end face is referred to as the upper side in the ink container described above.

Further, the "direction of normal of the end face in which the ink discharge port is formed" means a direction in which ink is discharged out of the directions in which normal of the above end face extends.

In accordance with the ink container loading structure of the present invention, since the ink container engaging direction of the ink discharge port of the ink container with the ink container engagement portion is directed obliquely downward with respect to the horizontal, the ink remaining on the inner side of the ink discharge port and/or near the ink discharge port after the ink in the ink container is used up can be caused to flow to the recording apparatus whereby the remaining ink can be prevented from running from the ink container to stain the operator's hand or the recording apparatus's surroundings of the ink container loading portion when the ink container is removed from the recording apparatus. Further, it is possible to recover the remaining ink caused to flow to the recording apparatus to reuse it.

When the ink discharge port in the ink container employed in the ink container loading structure of the present invention is provided in an end face of the ink container in the ink container loading direction, loading of the ink container in the recording apparatus is facilitated since engagement of the ink discharge port with the ink container engagement portion can be effected simultaneously with loading of the ink container in the recording apparatus.

In accordance with the ink container of the present invention, since the ink discharge port of the ink container is formed in an end face of the container body so that the central axis of the ink discharge port is directed obliquely downward with respect to the direction in which the upper side surface of the container body extends, the central axis of the ink discharge port can be directed obliquely downward with respect to the horizontal when the ink container is loaded in the recording apparatus with the upper side face of the container body held in the horizontal direction, whereby the ink remaining on the inner side of the ink discharge port and/or near the ink discharge port after the ink in the ink container is used up can be caused to flow to the recording apparatus and the remaining ink can be prevented from running from the ink container to stain the operator's hand or the recording apparatus's surroundings of the ink container loading portion when the ink container is removed from the recording apparatus.

Further, when the container body is formed so that the direction of normal of the end face in which the ink discharge port is formed is parallel to the direction of the central axis of the ink discharge port in the ink container of the present invention, the ink discharge port can be formed at 90° to the end face. Accordingly, processing during production of the product such as molding is facilitated.

Further, when a vent hole for taking the atmosphere in the container body is provided in the upper part of the end face in which the ink discharge port is formed so that the direction of the central axis of the vent hole is directed obliquely downward with respect to the direction in which the upper side surface of the container body extends, loading of the ink container in the recording apparatus is facilitated. When the vent hole is formed so that the normal of the end face in which the vent hole is formed is directed obliquely downward with respect to the direction in which the upper side surface of the container body extends, a larger amount of ink can be accommodated in the ink container as compared with, for instance, when the vent hole is formed so that the end face is at 90° to the upper side surface of the container body.

Further, when the direction of central axis of the ink discharge port is parallel to the direction of the central axis of the vent hole, engagement of the ink discharge port and the vent hole of the ink container with the ink container loading portion is facilitated.

PREFERRED EMBODIMENTS OF THE INVENTION

Figure 1:
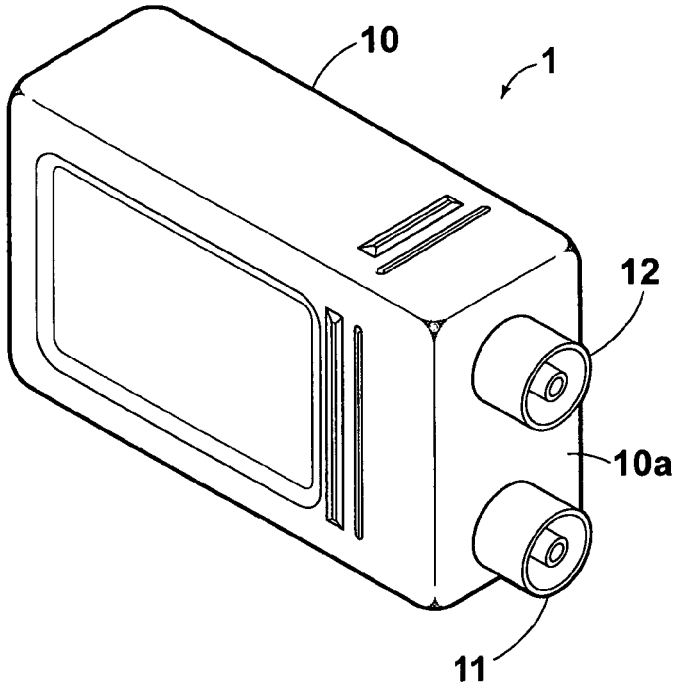
FIG. 1 is a perspective view showing an ink container used in an ink container loading structure in accordance with an embodiment of the present invention.

An ink container loading structure in accordance with an embodiment of the present invention will be described, hereinbelow, with reference to the drawings. FIG. 1 is a view showing in brief an ink container used in an ink container loading structure of this embodiment.

An ink container 1 used in this ink container loading structure comprises, as shown in FIG. 1, a substantially rectangular ink container body 10 of resin. An ink discharge port 11 through which ink filled in the ink container body 10 is discharged and a vent hole 12 for taking the atmosphere in the container body 10 are provided in an end face 10*a* of the ink container body 10. Though being rectangular in this embodiment, the ink container body 10 need not be limited to those which are rectangular but may be of other various shapes. For instance, the ink container body 10 may be cylindrical in shape.

Figure 2:
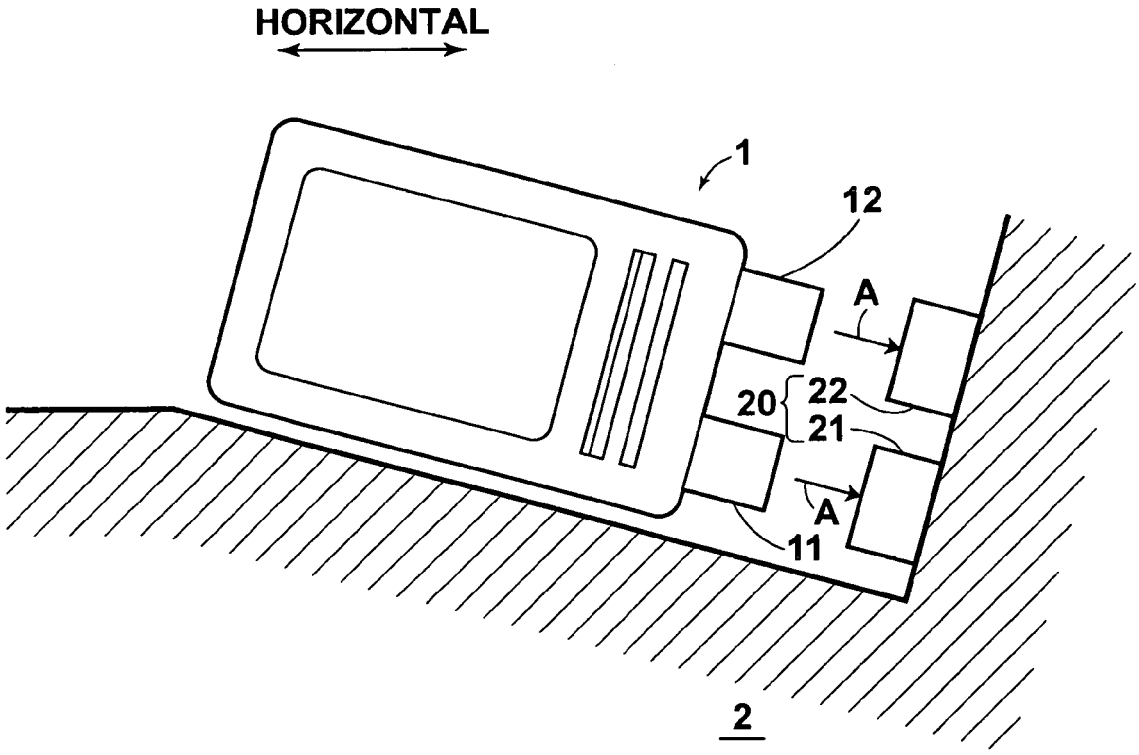
FIG. 2 is a view of an ink container loading structure in accordance with an embodiment of the present invention.

FIG. 2 shows in brief an ink container loading structure in accordance with an embodiment of the present invention.

The ink container loading structure comprises an ink container 1 structured as described above, and an ink container loading portion 2 in which the ink container 1 is loaded and is provided with an engagement portion 20 comprising an ink suction hole 21 with which the ink discharge port 11 of the ink container 1 is engaged and a vent hole 22 with which the vent hole 12 of the ink container 1 is engaged. The ink suction hole 21 and the vent hole 22 are respectively cylindrical in shape, and the ink discharge port 11 and the vent hole 12 of the ink container 1 are respectively fit in the cylindrical ink suction hole 21 and the cylindrical vent hole 22. Further, the ink suction hole 21 and the vent hole 22 are structured so that the ink discharge port 11 and the vent hole 12 of the ink container 1 are respectively removable therefrom.

As shown in FIG. 2, the ink container loading portion 2 of this embodiment is structured so that the ink container engaging directions of the ink discharge port 11 and the vent hole 12 of the ink container 1 (respectively shown by arrows A) are directed obliquely downward with respect to the horizontal.

When the ink container loading portion 2 is structured as described above, the ink remaining on the inner side of the ink discharge port 11 and the vent hole 12 and/or near the ink discharge port 11 and the vent hole 12 after the ink is used up can be caused to flow to the ink container loading portion 2 whereby the remaining ink can be prevented from running from the ink container 1 to stain the operator's hand or the recording apparatus's surroundings of the ink container loading portion 2 when the ink container 1 is removed from the ink container loading portion 2. Further, it is possible to recover the remaining ink caused to flow to the ink container loading portion 2 to reuse it. The ink discharge port 11 and the vent hole 12 of the ink container 1 of this embodiment are sealed by a known sealing means such as a valve, and the ink discharge port 11 and the vent hole 12 are communicated with the ink container loading portion 2 in response to engagement with the engagement portion 20 of the ink container loading portion 2.

Figure 3:
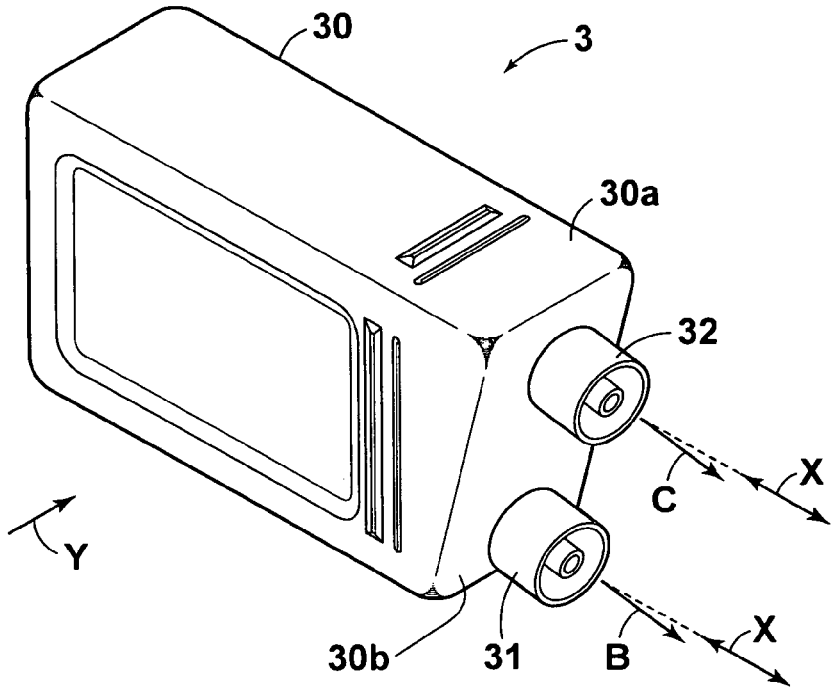
FIG. 3 is a view of an ink container in accordance with an embodiment of the present invention.
Figure 4:
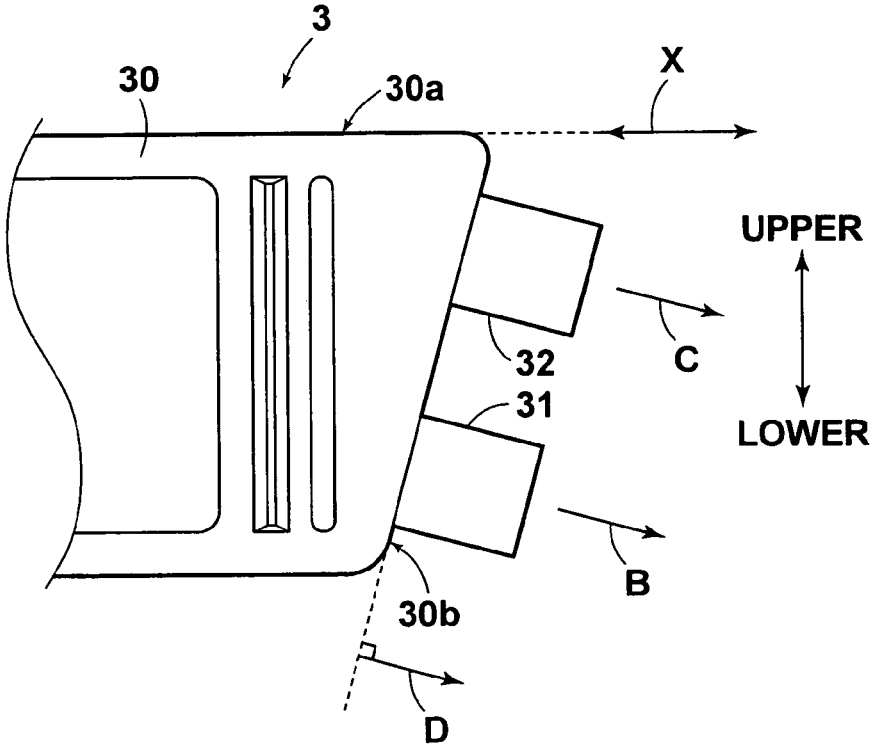
FIG. 4 is a view showing the ink container shown in FIG. 3 as viewed in the direction of arrow Y.

Other embodiments of the ink container of the present invention will be described hereinbelow. FIG. 3 is a view of an ink container in accordance with an embodiment of the present invention, and FIG. 4 is a view showing the ink container 3 shown in FIG. 3 as viewed in the direction of arrow Y.

An ink container 3 of this embodiment, as the ink container 1 of the embodiment described above, comprises an ink container body 30 of resin, an ink discharge port 31 through which ink filled in the ink container body 30 is discharged and a vent hole 32 for taking the atmosphere in the container body 30. However, in the ink container 3 of this embodiment, as shown in FIGS. 3 and 4, the ink discharge port 31 and the vent hole 32 are provided in an end face 30*b* of the container body 30 so that the central axis of the ink discharge port 31 (that is, a direction in which ink is discharged out of the directions in which the central axes of the ink discharge port extend: the direction of arrow B) and the direction of the central axis of the vent hole 32 (that is, a direction opposite to the direction in which the atmosphere is taken in the container body 30 out of the directions in which the central axes of the vent hole 32 extend: the direction of arrow C) are directed obliquely downward with respect to the direction in which the upper side surface 30*a* of the container body 30 extends (that is, a direction shown by double-headed arrows X). The upper side surface 30*a* is a side surface of the ink container 30 opposed to the side of the ink discharge port 31 in the end face in which the ink discharge port 31 is formed out of the side surfaces of the ink container 3. That is, the side on which the ink discharge port 31 is provided in the above end face 30*b* is referred to as the lower side and the side opposite to the side on which the ink discharge port 31 is provided in the above end face 30*b* is referred to as the upper side in the ink container 3 described above as shown in FIG. 4.

The central axis of the ink discharge port 31 can be directed obliquely downward with respect to the horizontal when the ink container 3 structured as described above is loaded in the recording apparatus with the upper side face 30*a* of the container body 30 held in the horizontal direction, whereby the ink remaining on the inner side of the ink discharge port 31 and/or near the ink discharge port 31 after the ink in the ink container 3 is used up can be caused to flow to the recording apparatus and the remaining ink can be prevented from running from the ink container 3 to stain the operator's hand or the recording apparatus's surroundings of the ink container loading portion when the ink container 3 is removed from the recording apparatus.

Further, in the ink container 3, since the container body 30 is formed so that the direction of normal of the end face 30*b* (that is, a direction in which ink is discharged out of the directions in which the normal of the end face 30*b* extend: a direction shown by arrow D) in which the ink discharge port 31 and the vent hole 32 are formed is parallel to the direction of the central axes of the ink discharge port 31 and the vent hole 32 (directions respectively shown by arrows B and C), the ink discharge port 31 and the vent hole 32 can be formed at 90° to the end face 30*b*. Accordingly, processing during production of the product such as molding is facilitated.

Figure 5A:
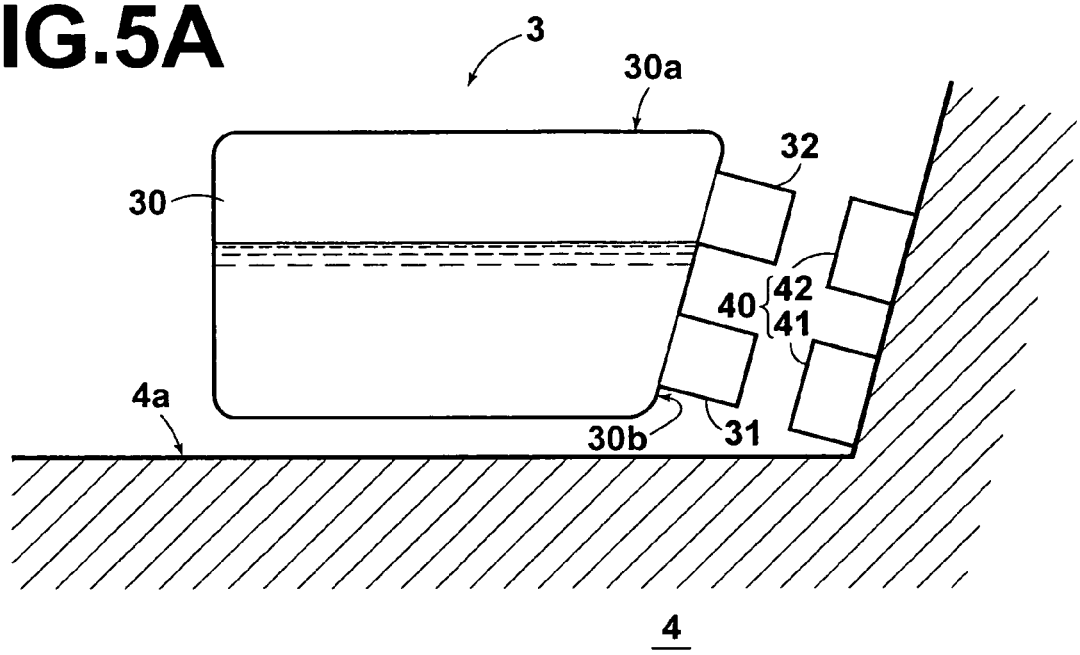
FIGS. 5A and 5B are views for illustrating the operation and the effect of the ink container shown in FIG. 3.
Figure 5B:
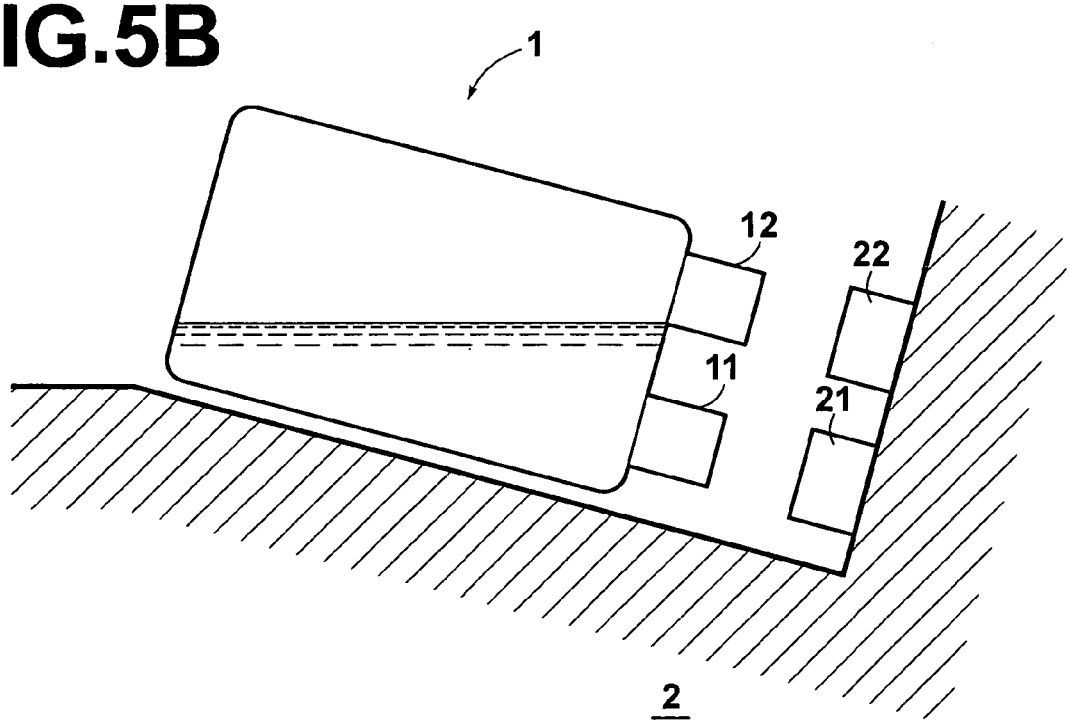

In the ink container 1 and the ink container loading portion 2 shown in FIGS. 1 and 2, ink can be filled only to below the vent hole 12 of the ink container 1 in a state where the ink container 1 is loaded in the ink container loading portion 2 as shown in FIG. 5B, whereby the volume of the ink in the ink container 1 is reduced. To the contrast, when the ink container 3 is structured as described above, since the end face 30*b* of the ink container 3 is directed obliquely downward with respect to the direction in which the upper side surface 30*a* of the container body 30 extends as shown in FIG. 5A, the upper side surface 30*a* and the lower side surface of the ink container 3 can be nearer to the horizontal, whereby more amount of ink can be accommodated in the ink container 3 as compared with the ink container 1 shown in FIGS. 1 and 2.

Further, in the ink container 3, the central axes of the ink discharge port 31 and the vent hole 32 are normal to the end face 30*b* in parallel to each other. When the ink discharge port 31 and the vent hole 32 are formed in the end face 30*b*, engagement of the ink discharge port 31 and the vent hole 32 with the ink container loading portion is facilitated.

Though, in the ink container loading portion 4 shown in FIG. 5A, the surface 4*a* on which the ink container 3 is mounted is substantially horizontal, the surface 4*a* on which the ink container 3 is mounted need not be limited to this structure but may be inclined so that the side of the engagement portion is lower, as in the ink container loading portion 2 shown in FIG. 2.

Figure 6:
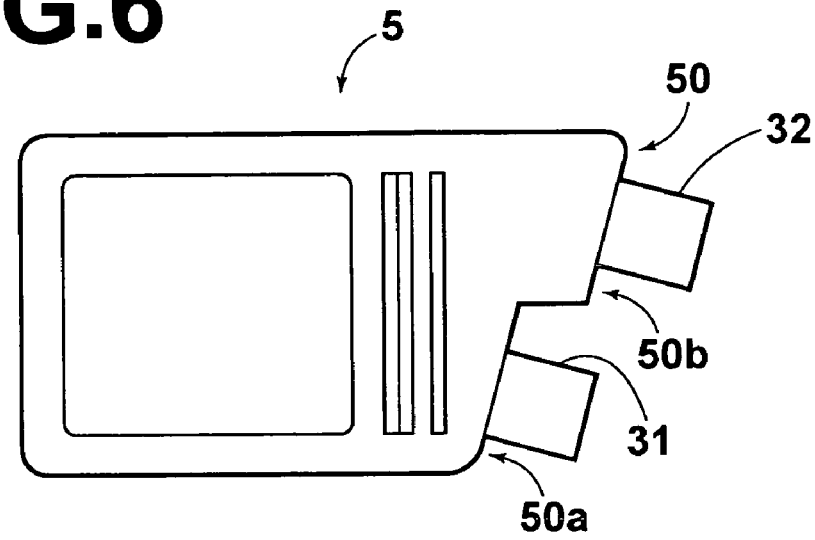
FIG. 6 is a view showing an ink container in accordance with another embodiment of the present invention.

Though, in the ink container 3 of the embodiment described above, the ink discharge port 31 and the vent hole 32 are formed in the end face 30*b* which is flat, but the ink container 3 need not be limited to this structure but may have a stepped end face 50 as an ink container 5 shown in FIG. 6 and the ink discharge port 31 and the vent hole 32 may be formed in the respective faces 50*a* and 50*b* of the end face 50.

Figure 7:
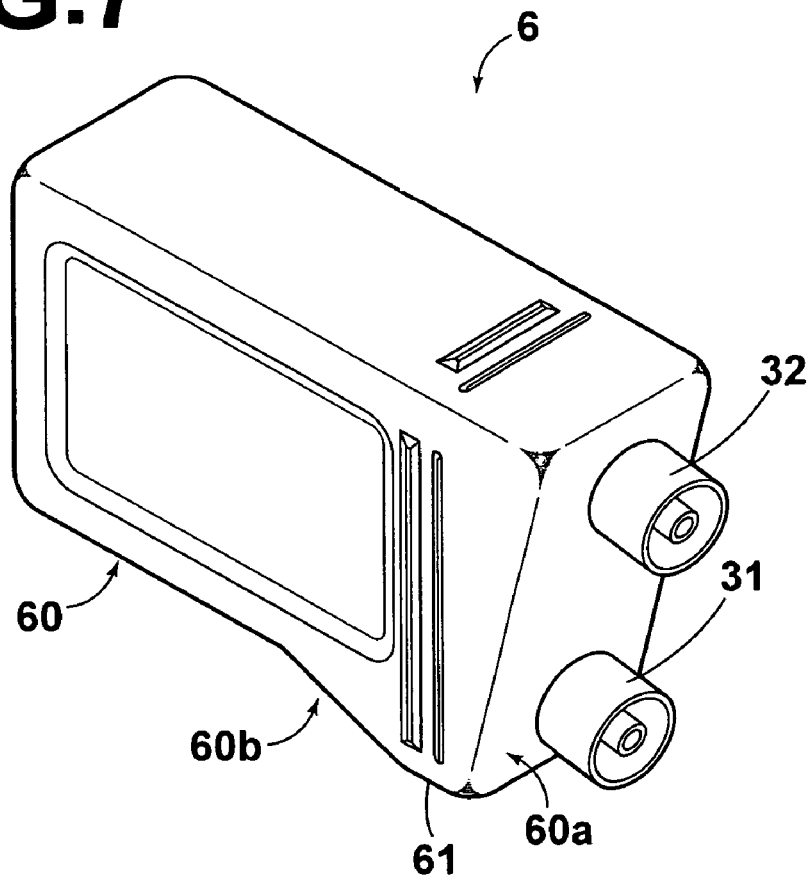
FIG. 7 is a view showing an ink container in accordance with still another embodiment of the present invention.

Further, as an ink container 6 shown in FIG. 7, an inclined surface 60*b* which is inclined downward toward an end face 60*a* where the ink discharge port 31 and the vent hole 32 are formed may be formed in a lower side surface 60 on the side of the end face 60*a*. For example, when the ink remaining in the ink container is very little in its amount and the viscosity of the remaining ink is high, there are sometimes cases where such high viscosity ink should not be supplied to the recording apparatus. When such an inclined surface 60*b* is provided, the high viscosity ink can be stored in a projection 61 which is defined by the inclined surface 60*b* and is convex downward, whereby such high viscosity ink can be prevented from flowing to the recording apparatus.

In the ink containers in accordance with the above embodiments, the ink discharge port and the vent hole of the ink container before the ink container is loaded in a recording apparatus may be sealed in a movable sealing method such as a plug or a valve, or by applying film and may be unsealed by piercing or peeling off the film. Further, the ink discharge port and the vent hole may be sealed by rubber and may be permitted to communicate with the inside of the ink container by piercing the rubber with a tube like a needle of a syringe.

An ink bearing plate may be provided below the engagement portion of the ink loading portion in accordance with the above embodiments so that even if ink runs from the ink container when the ink container is removed, the ink can be received by the plate and caused to flow to the recording apparatus.

It is preferred that the material of the ink container of this invention meets conditions that the material itself or the components of the material is less apt to attack ink, the material does not bulge with ink, the components of ink does not ooze out through the material and the amount of oxygen passing through the material from the atmosphere is small.

The material which meets the above conditions includes polyester- or polyolefin-based mono-layer or poly-layer materials. When a poly-layer material is employed, it is preferred that an ethylene-vinyl alcohol copolymer or nylon layer be positioned inside the polyolefin layer or be interposed between polyolefin layers as a barrier layer. Especially, when the innermost layer is of polyolefin, adhesiveness during blow molding is excellent. However, the material of the ink container of the present invention need not be limited to the above materials.

Further, it is preferred that the ink container loading structure and the ink container of the present invention be applied to an ink jet printer using low viscosity ink.

What is claimed is:

1. An ink container loading structure comprising an ink container provided with a container body in which ink is stored and an ink discharge port through which ink in the container body is discharged and an ink container loading portion provided with an ink container engagement portion in which the ink container is loaded and with which the ink discharge port of the ink container is engaged, wherein the improvement comprises that the ink container engaging direction of the ink discharge port formed in an end face of the ink container with the ink container engagement portion is directed obliquely downward with respect to the horizontal and the central axis of the ink discharge port is directed obliquely downward with respect to the direction in which the upper surface of the container body extends.

2. An ink container employed in the ink container loading structure defined in claim 1 in which the ink discharge port is provided in an end face of the ink container in the ink container loading direction.

3. An ink container as defined in claim 1 in which the direction of the normal of the end face in which the ink discharge port is formed is parallel to the direction of the central axis of the discharge port.

4. An ink container as defined in claim 3 in which a vent hole for taking the atmosphere in the container body is formed in an upper part of the end face in which the ink discharge port is formed, and the direction of the central axis of the vent hole is directed obliquely downward with respect to the direction in which the upper side surface of the container body extends.

5. An ink container as defined in claim 3 in which the direction of the central axis of the ink discharge port is parallel to the direction of the central axis of the vent hole.

6. An ink container as defined in claim 1 in which a vent hole for taking the atmosphere in the container body is formed in an upper part of the end face in which the ink discharge port is formed, and the direction of the direction of the central axis of the vent hole is directed obliquely downward with respect to the direction in which the upper side of the surface of the container body extends.

7. An ink container as defined in claim 6 in the which the direction of the central axis of the ink discharge port is parallel to the direction of the central axis of the vent hole.

8. An ink container as defined in claim 1 in which the direction of the central axis of the ink discharge port is parallel to the direction of the central axis of the vent hole.

* * * * *

UNITED STATES PATENT AND TRADEMARK OFFICE

CERTIFICATE OF CORRECTION

PATENT NO. : 7,287,844 B2
APPLICATION NO. : 10/574559
DATED : October 30, 2007
INVENTOR(S) : Takahiro Wakayama, Takashi Miyazawa and Masashi Matsuda It is certified that error appears in the above-identified patent and that said Letters Patent is hereby corrected as shown below:

ON THE COVER PAGE

Item under (73) Assignees:

In addition to Riso Kagaku Corporation, please add the second assignee

--Olympus Corporation, 2-43-2 Hatagaya, Shibuya-ku, Tokyo, Japan--.

Signed and Sealed this

Second Day of September, 2008

JON W. DUDAS
*Director of the United States Patent and Trademark Office*